US006473052B1

(12) United States Patent
Schmid

(10) Patent No.: US 6,473,052 B1
(45) Date of Patent: Oct. 29, 2002

(54) DEVICE FOR THE ACCURATE POSITIONING OF AN ANTENNA

(75) Inventor: Manfred Schmid, Immenstaad (DE)

(73) Assignee: Dornier GmbH, Friedrichshafen (DE)

( * ) Notice: Subject to any disclaimer, the term of this patent is extended or adjusted under 35 U.S.C. 154(b) by 0 days.

(21) Appl. No.: 09/635,646

(22) Filed: Aug. 10, 2000

(30) Foreign Application Priority Data

Aug. 10, 1999 (DE) ..... 199 37 765

(51) Int. Cl.[7] ..... H01Q 1/18; H01Q 3/08
(52) U.S. Cl. ..... 343/765; 343/766
(58) Field of Search ..... 343/765, 766, 343/882, 709; H01Q 1/18, 3/00, 3/02, 3/08

(56) References Cited

U.S. PATENT DOCUMENTS 4,647,939 A 3/1987 Kolhoff ..... 343/765
5,579,018 A * 11/1996 Francis et al. ..... 343/765

* cited by examiner

*Primary Examiner*—Michael C. Wimer
(74) *Attorney, Agent, or Firm*—Crowell & Moring LLP

(57) ABSTRACT

A device is provided for the accurate positioning of an antenna of a satellite in space, in which the antenna is fastened to a plate mounted on gimbals, with the plate capable of being swiveled around two axles supported in bearings and extending vertically to one another. A rotary drive is provided for each axle, said rotary drive consisting of an arm of a lever, said arm being connected to the axle, and a linear drive that freely affects the arm.

12 Claims, 5 Drawing Sheets

20
22
24
26, 36
12
34
32
8
6
10
18

DEVICE FOR THE ACCURATE POSITIONING OF AN ANTENNA

BACKGROUND AND SUMMARY OF INVENTION

This application claims the priority of German patent document 199 37 765, filed Aug. 10, 1999 the disclosure of which is expressly incorporated by reference herein.

The invention relates to a device for the accurate positioning of an antenna of a satellite. In technical terms, this is known as an "antenna pointing mechanism", or "APM" for short.

Placing the antenna on or at a universal joint (gimbal) and providing a drive for each of the axles extending perpendicular with respect to one another is common knowledge. This drive may be an angular resolver, e.g., a stepper motor or a toothed gearing.

The following are objects of the invention:

during the start phase, the antenna and universal joint should not exert any force on the drive;

during the start phase, the antenna and the universal joint should be in a locked position;

at the end of the start phase, the antenna should accurately take a preset position; and during the operation, it should be possible to change the position of the antenna in a highly precise manner.

These objects are achieved according to the invention by providing a gear for accurate positioning of an antenna of a satellite in space, in which the antenna is fastened to a plate mounted on gimbals, with said plate capable of being swivelled around two axles running perpendicular with respect to one another and stored in bearings, and with a rotary drive provided for each axle, characterized in that the rotary drive includes an arm of a lever, said arm being connected to the axle, and a linear drive that freely affects the arm.

Other objects, advantages and novel features of the present invention will become apparent from the following detailed description of the invention when considered in conjunction with the accompanying drawings.

DETAILED DESCRIPTION OF THE DRAWINGS

Figure 1:
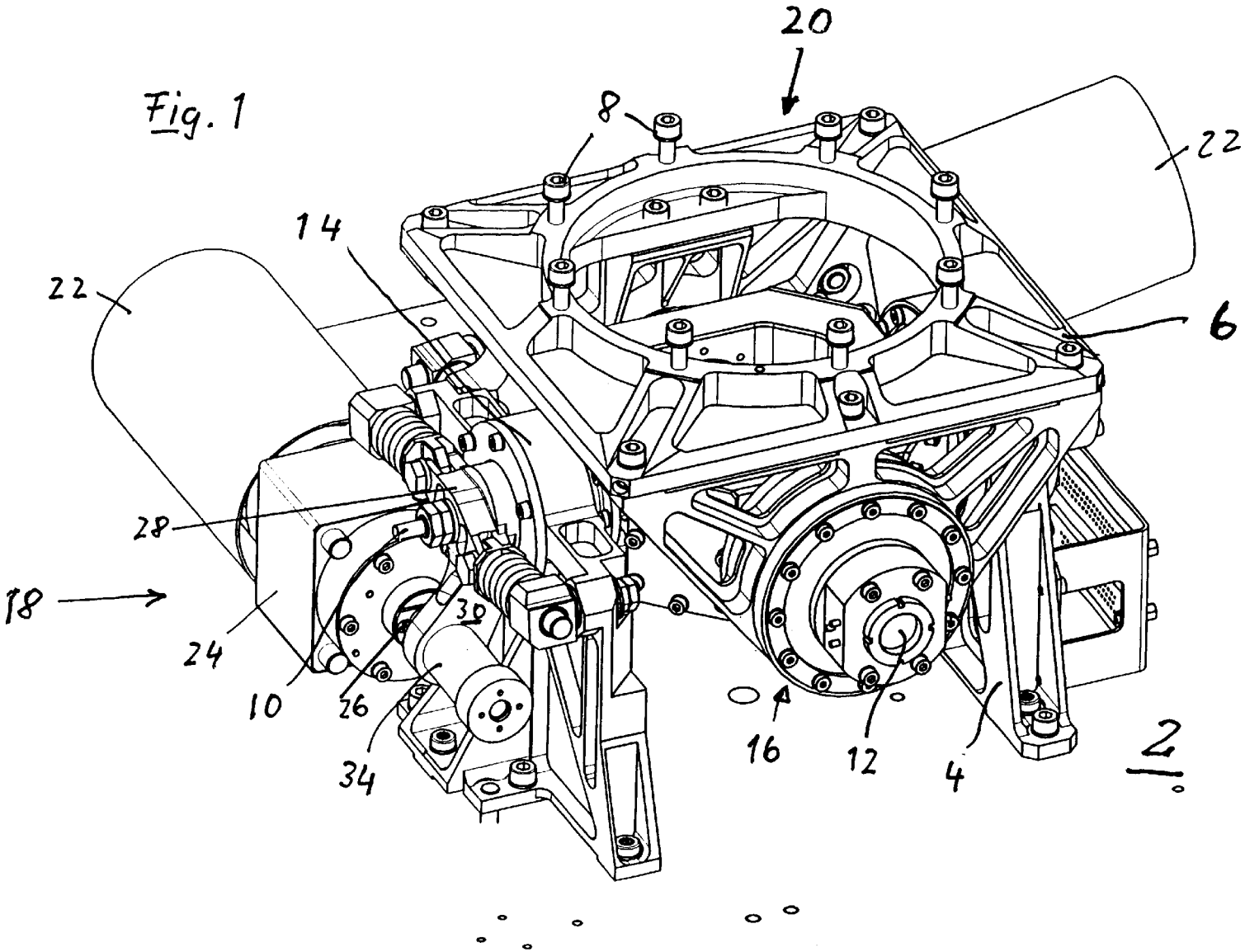
FIG. 1 is an axonometric perspective representation of a device, for positioning an antenna, constructed according to a preferred embodiment of the invention.
Figure 2:
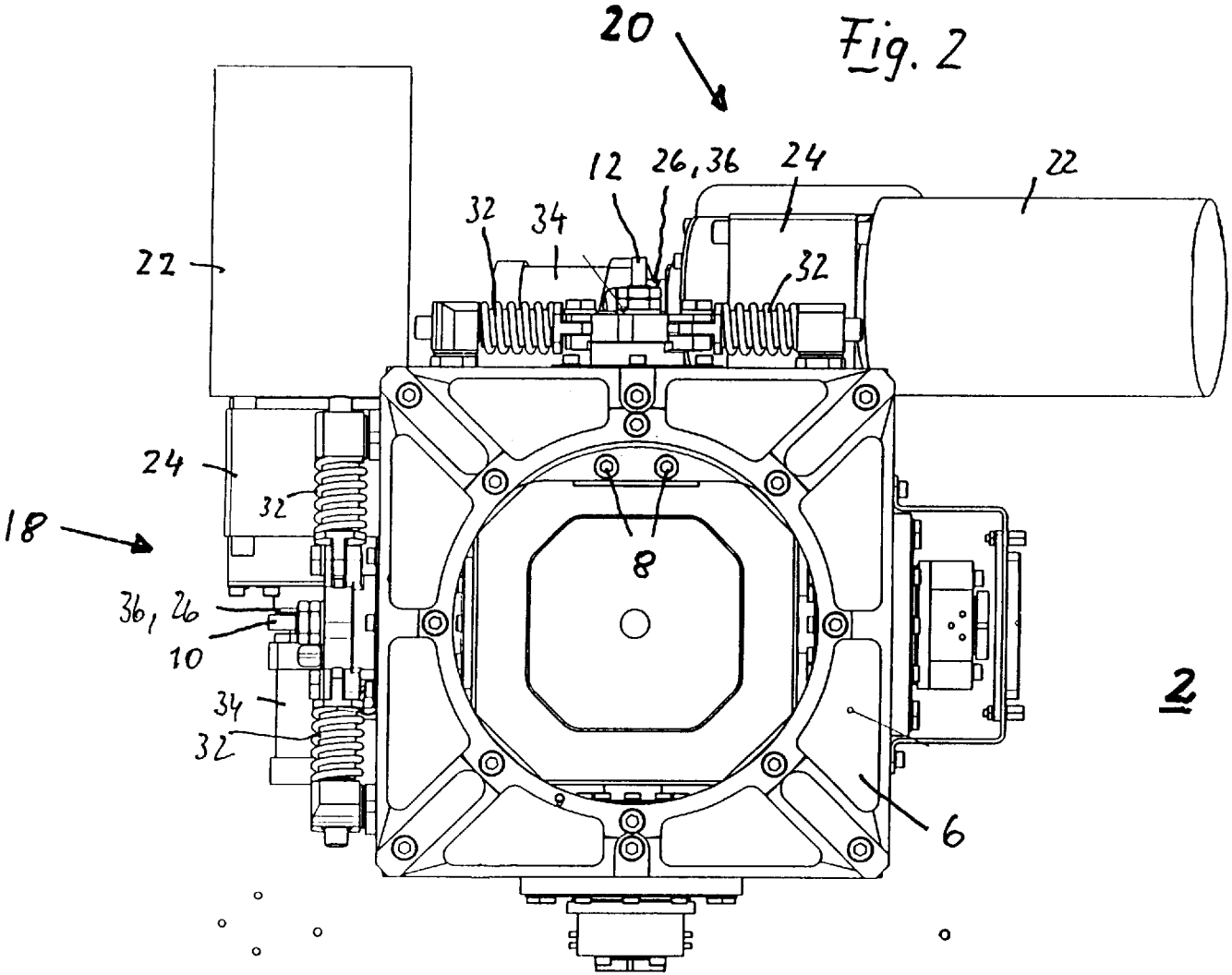
FIG. 2 is a top view of the subject of FIG. 1.

FIG. 1 shows a base plate 2, which can be a part of a satellite and onto which a frame 4 is fastened. The frame 4 has a plate 6 suspended on gimbals, with fastening devices 8 for an antenna (not shown) or another useful load. From the universal joint, the axles 10, 12, as well as the bearings 14, 16, can be seen in FIG. 1. The axles 10, 12 are rigidly connected to the plate 6 and their angular movement independent of one another causes the positioning of an antenna, which is on the plate 6. The drives 18, 20 for each of the two axles 10, 12 that run perpendicular to one another comprises:

a geared motor 22 with a spindle unit 24 and a level spindle end plate 26, a lever 28 (which is fastened to an axle 10 or 12) and exhibiting an arm 30, spring elements 32 on both sides of the lever 28, which are connected on the one hand to the lever and on the other hand to the frame of the universal joint, and a damper 34, which is fastened to the arm 30 and exhibits a crowned end plate 36.

Figure 3:
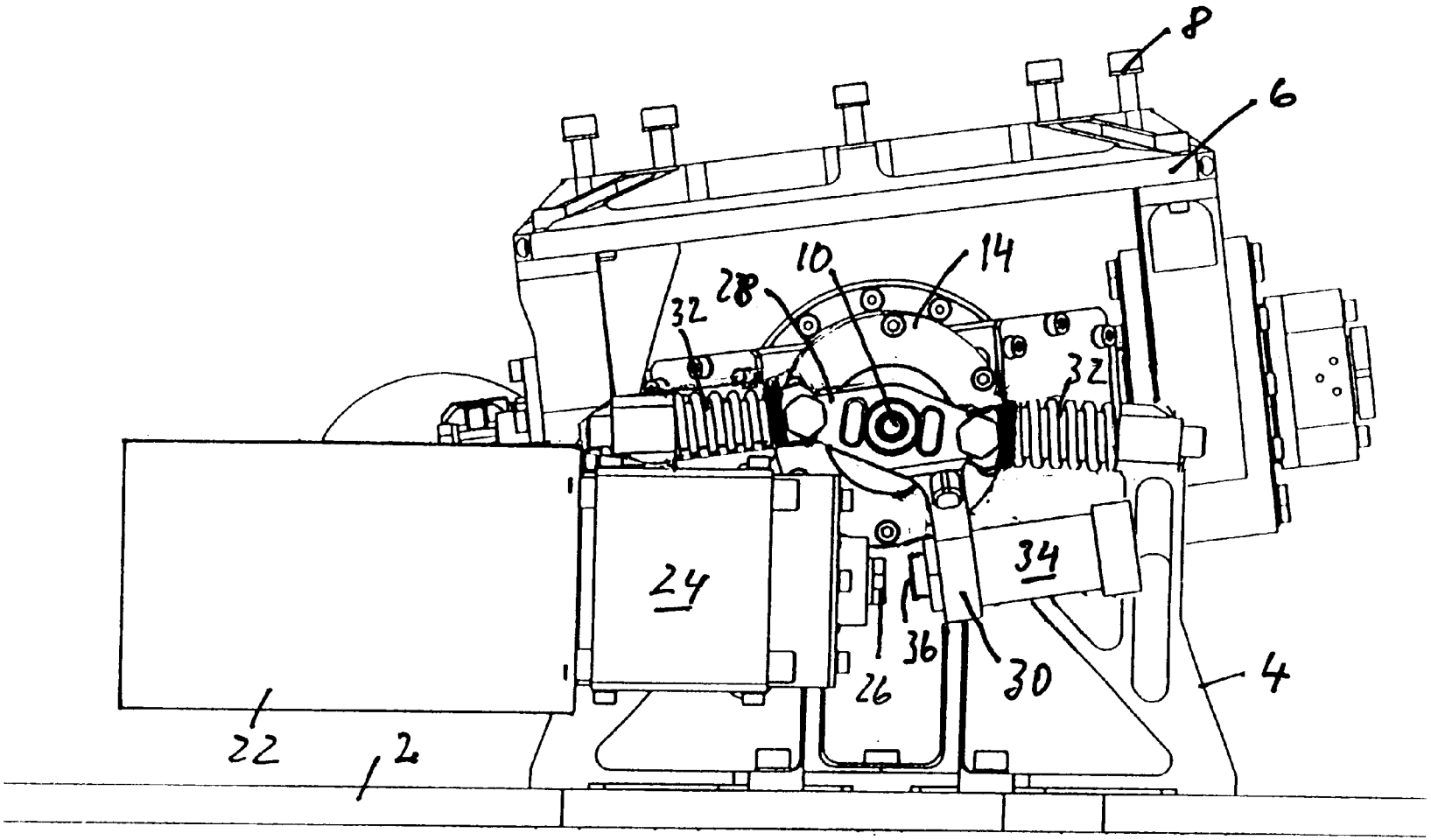
FIG. 3 is a side view showing a start phase using the device of FIGS. 1 and 2.
Figure 4:
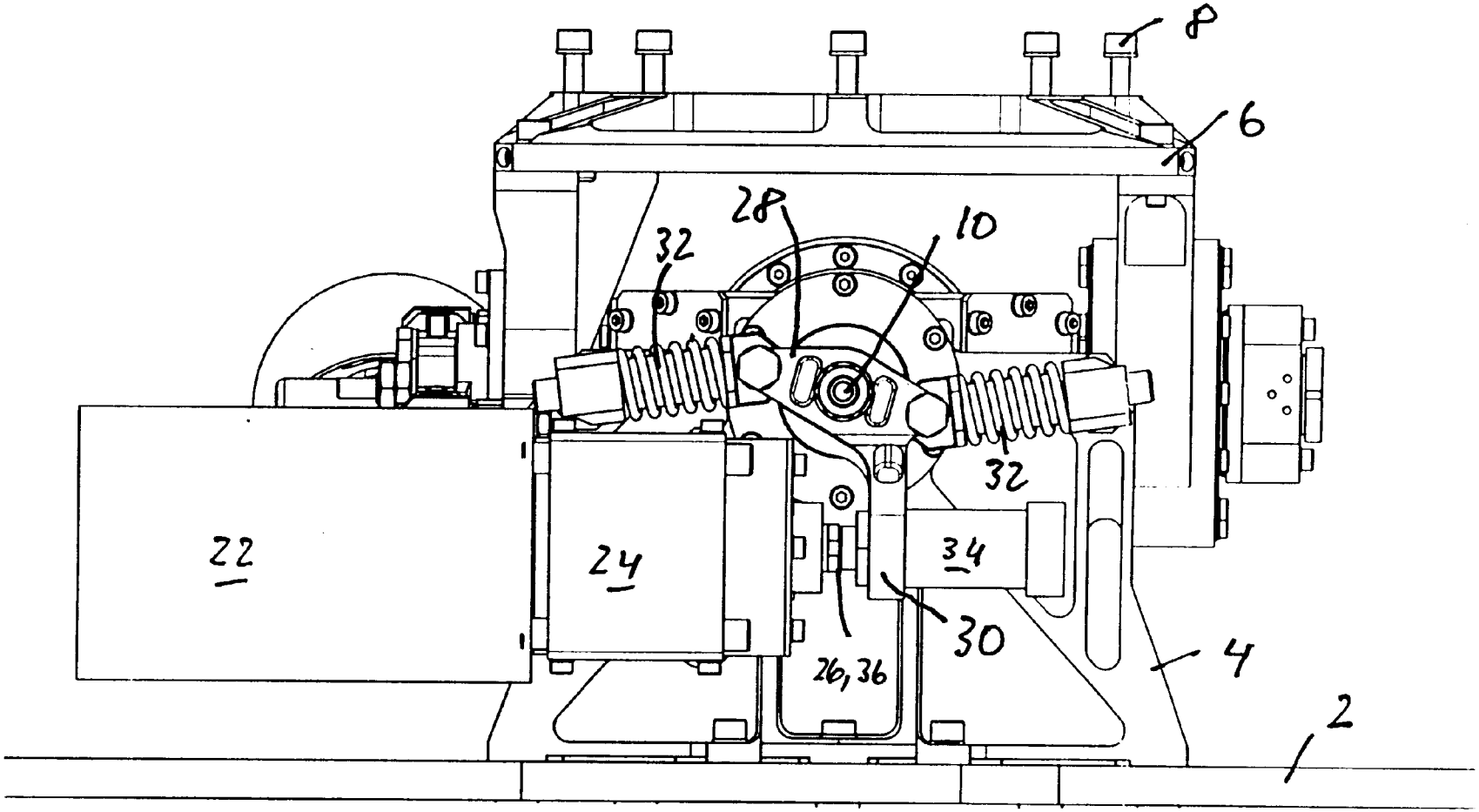
FIG. 4 is a side view showing device with operation of the antenna.

The function of the device according to the invention becomes clear in FIGS. 3 and 4:

As shown in FIG. 3, the spring elements 32 are prestressed and locked before the start. Between the end plate 36 of the damper 34 and the end plate 26 of the spindle is a gap so that during start and the flight, none of the accelerating power caused by the antenna can have an effect on the spindles 24, 26.

Figure 3A:
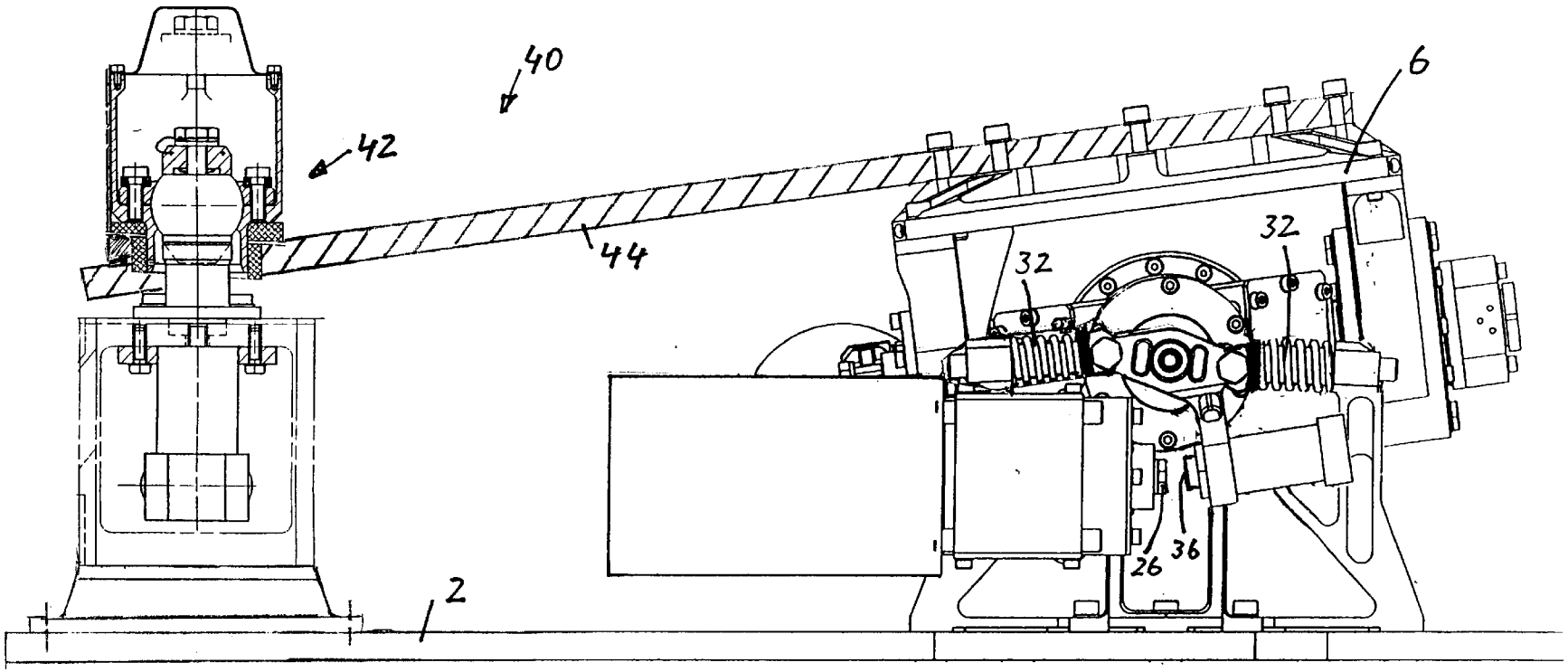
FIG. 3*a* is a device for locking the universal joint of the device of FIGS. 1–3 during the start phase.

FIG. 3*a* shows a holding device which prestresses the spring elements 32 as mentioned in connection with the description of FIG. 3 and locks the universal joint during the start. The holding device 40 comprises a device 42 known in pyrotechnics, which is fastened to the base plate 2, and a lever 44, which is connected on the one hand to the pyrotechnic device 42, and on the other hand to the plate 6. When the start phase has ended, the pyrotechnic device 42 is ignited and releases the lever 44. The lock is disengaged and the elastic force of the prestressed spring elements 32 can now place the end plates 26, 36 in the position shown in FIG. 4 so that the universal joint reaches the preset location.

Once the satellite has reached its orbit, the plate 6, which is fixed during the start by the holding device of FIG. 3*a,* is released. Driven by the spring elements 32, the plate then swings to its preset location, as illustrated in FIG. 4. As a result of the action of the damper 34, the end plates 26 and 36 do not come into contact with force. In the position shown in FIG. 4, an antenna or another useful load can be put in operation.

Adjusting or resetting the antenna is possible at any time. To do this, the geared motor 22 is operated and the spindle 24, 26, forming a linear drive, moves sensitively in an axial direction against the end plate 36. The end plate 36 as well as the arm 30 and the lever 28 are moved against the dynamic effect of the spring elements 32. This brings about an angular rotation of the respective axle 10, 12, and consequently, an accurate positioning of the antenna.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A device for accurate positioning of an antenna of a satellite in space, comprising:

a plate to which the antenna can be fastened mounted on gimbals, two axles extending perpendicularly with respect to each other and carried in bearings, said plate capable of being swivelled about the two axles, and a rotary drive provided for each axle, wherein each rotary drive comprises a single linear drive and an arm of a lever, and wherein said arm is connected at one end thereof to one of the axles, is connected at another end thereof to a damper, and is movable by the linear drive.

2. The device according to claim 1, wherein said linear drive has a level end plate, and wherein said level end plate is movable against a crowned end plate of said damper.

3. A device for accurate positioning of an antenna of a satellite in space, comprising:

a plate to which the antenna can be fastened mounted on gimbals, two axles extending perpendicularly with respect to each other and carried in bearings, said plate capable of being swivelled about the two axles, a rotary drive provided for each axle, each rotary drive comprising a linear drive and an arm of a lever, said arm being connected to the axle, and the linear drive being able to move the arm, and spring elements coupled on the one hand at the lever and on the other hand at a universal joint frame.

4. A device for accurate positioning of an antenna of a satellite in space, comprising:

a plate to which the antenna can be fastened mounted on gimbals, two axles extending perpendicularly with respect to each other and carried in bearings, said plate capable of being swivelled about the two axles, a rotary drive provided for each axle, each rotary drive comprising a linear drive and an arm of a lever, said arm being connected to the axle, and the linear drive being able to move the arm, the arm being connected to a damper, said linear drive having a level end plate, and said level end plate being movable against a crowned end plate, and spring elements coupled on the one hand at the lever and on the other hand at a universal joint frame.

5. The device according to claim 3, and further comprising a release device for the plate, and consequently, for the spring elements, said release device being placed outside of the rotary drives.

6. The device according to claim 4, and further comprising a release device for the plate, and consequently, for the spring elements, said release device being placed outside of the rotary drives.

7. An assembly for accurately positioning an antenna of a satellite in space, comprising:

an antenna support plate mounted to be pivotable about two axles, and a rotary drive for each of the axles, each of said rotary drives including an arm, connected at one end thereof to one of the axles and at another end thereof to a damper, and a single linear drive operable to move said arm and thus rotate said one of the axles.

8. The assembly according to claim 7, and further comprising a universal joint frame which operably supports the axles and rotary drives.

9. An assembly for accurately positioning an antenna of a satellite in space, comprising:

an antenna support plate mounted to be pivotable about two axles, a rotary drive for each of the axles, each of said rotary drives including an arm connected to a respective axle and a linear drive operable to move the arm and thus rotate a respective one of the axles, a universal joint frame which operably supports the axles and rotary drives, and spring elements connecting respective levers with the frame.

10. The assembly according to claim 9, and further comprising a release device operable to hold the assembly in a stowage position for transport to a position in space and to subsequently release the assembly to an operative antenna holding position.

11. The assembly according to claim 10, wherein the release device includes means to hold the spring elements and linear drives, away from antenna positioning positions where the assembly is in the storage position.

12. The assembly according to claim 11, wherein the release device includes a pyrotechnic actuable release mechanism.

* * * * *